United States Patent [19]

Anton et al.

[11] 4,075,378

[45] Feb. 21, 1978

[54] POLYAMIDE FILAMENTS WITH A BASIC-DYEABLE SHEATH AND AN ACID-DYEABLE CORE AND DYEING PROCESS THEREFOR

[75] Inventors: Anthony Anton; Joseph Arthur Benoit Nolin, both of Wilmington, Del.

[73] Assignee: E. I. Du Pont de Nemours and Company, Wilmington, Del.

[21] Appl. No.: 612,730

[22] Filed: Sept. 12, 1975

[51] Int. Cl.[2] ..... B32B 3/02; B32B 33/00

[52] U.S. Cl. ..... 428/97; 8/1 N; 8/1 XB; 8/15; 8/25; 8/178 R; 8/178 A; 428/225; 428/369; 428/373; 428/374

[58] Field of Search ..... 428/97, 369, 373, 374, 428/225; 8/1 N, 1 XB, 15, 25, 178 R, 178 A

[56] References Cited

U.S. PATENT DOCUMENTS

| | | | |
|---|---|---|---|
| 2,989,798 | 6/1961 | Bannerman | 428/373 |
| 3,843,609 | 10/1974 | Kimura | 428/373 |

OTHER PUBLICATIONS

Publication of Japanese Patent Application No. 47-21613/1972, June 17, 1972.

*Primary Examiner*—Marion E. McCamish

[57] ABSTRACT

A synthetic polyamide filament is composed of an acid-dyeable polyamide core surrounded by a basic-dyeable polyamide sheath containing aromatic sulfonate groups. At a normal dyeing pH of 4–7 the core accepts leveling acid dyes but not reserving acid or basic dyes. The sheath accepts leveling and nonleveling basic dyes. Versatility in cross-dye styling when such filaments are combined with acid-dyeable and basic-dyeable mono-component filaments is demonstrated.

10 Claims, 2 Drawing Figures

POLYAMIDE FILAMENTS WITH A BASIC-DYEABLE SHEATH AND AN ACID-DYEABLE CORE AND DYEING PROCESS THEREFOR

BACKGROUND OF THE INVENTION

1. Field of the Invention

This invention concerns a synthetic polyamide filament which is dyeable both with acid and with basic dyes. More particularly, it concerns a filament having a selectively acid-dyeable polyamide core surrounded by a basic-dyeable polyamide sheath. Such filaments provide unusual dye styling possibilities in the combination with other acid and basic-dyeable monocomponent polyamide filaments.

2. Description of the Prior Art

For styling purposes, the acid dyeability of polyamide filaments can be varied dependent upon the amine-end concentration. Basic-dyeability can be obtained by copolymerization with an amide constituent containing aromatic sulfonate groups. Polyamide filaments composed of two polyamides, one of which is free of sulfonate groups and the other of which contains basic-dyeable aromatic sulfonate groups, spun in a side-by-side configuration are described in Japanese Patent Application No. 21613/72. The filaments are receptive both to acid and to basic dyes. The acid-dyeability of such filaments is dependent upon the acid-dyeable groups in the polyamide component which is free of sulfonate groups. Greater versatility in dye styling effects could be realized by a polyamide filament which is receptive both to acid and to basic dyes but which provides further selectivity between different types of acid dyes.

SUMMARY OF THE INVENTION

This invention provides a synthetic polyamide filament composed of an acid-dyeable fiber-forming polyamide core which constitutes at least about 40 volume percent of the filament and which contains from 40 to 100 equivalents of amine end-groups per $10^6$ grams of the core polyamide; and, a substantially concentric, basic-dyeable, fiber-forming polyamide sheath which contains at least 50 equivalents of aromatic sulfonate groups per $10^6$ grams of the sheath polyamide, said sulfonate groups being chemically attached to the sheath polyamide. Preferably, the core polymer contains from 60 to 90 equivalents of amine end-groups and the sheath polyamide contains from 60 to 80 equivalents of the basic-dyeable sulfonate groups.

A preferred filament configuration contains substantially equal amounts by volume of the core and sheath polyamides.

The invention provides textile articles comprised of the filaments of the invention as well as such articles additionally containing acid-dyeable or basic-dyeable polyamide monocomponent filaments, or both, for multicolor styling effects.

Also comprehended by the invention is the process for cross-dyeing the filaments of the invention in an aqueous dye bath in the presence of a basic dye and a leveling acid dye at a pH of from 4 to 7.

DETAILED DESCRIPTION OF THE INVENTION

Figure 1:
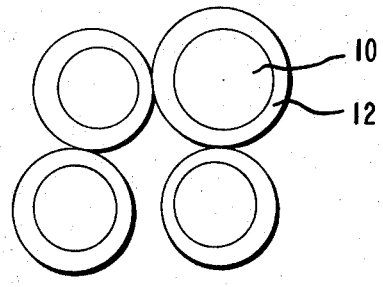
FIG. 1 typifies transverse cross-sections of round filaments of the invention showing the acid-dyeable polyamide core 10 surrounded by the basic-dyeable polyamide sheath 12.
Figure 2:
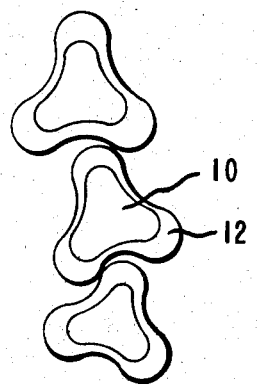
FIG. 2 typifies transverse cross-sections of trilobal filaments of the same composition as FIG. 1.

The polyamide filaments of this invention provide new color styling possibilities when dyed competitively in yarns, fabrics and other textile articles containing other polyamide filaments. In the prior art, fabrics of acid-dyeable and basic-dyeable polyamide yarns can be dyed in a bath at pH 4 to 7 containing basic and acid dyes whereupon each yarn takes on the color of its respective dye or dyes. Also, a plurality of shades of the acid-dyed color can be obtained by using acid-dyeable polyamide species ranging from light-acid to deep-acid dyeable filaments depending upon the amine-end concentration of the polymer and/or the presence of deep-dyeable copolymer components such as tertiary amine groups which increase acid-dyeability. By this invention it is now possible to obtain another distinct color under such competitive dyeing conditions by the proper combination of dyes and basic- and acid-dyeable polyamide components in the sheath/core filament.

The unique dyeing behavior provided by this invention requires a polyamide filament having an acid-dyeable core and a basic-dyeable sheath. To have the desired effect, the core should constitute at least about 40 volume percent of the filament. To be sufficiently acid-dyeable, the core should have at least 40, and preferably 60, equivalents of amine end-groups per $10^6$ grams of polymer. The core can contain as much as 100 amine ends but no more than 90 equivalents are generally necessary. As used herein, "amine ends" and "end-groups" include any dyeable amine groups in the polymer chain, including secondary and tertiary amine groups. Secondary and tertiary amines are detectable in the potentiometric tritration curves for amine ends as a second weak break. The term amine "equivalents" includes primary, secondary and tertiary amine groups detected by such titration for total amine group concentration.

The basic-dyeable sheath contains at least about 50, and preferably 70 to 80 equivalents per $10^6$ grams of polymer of aromatic sulfonate groups. Such sheath polymers normally contain from about 15 to 40 equivalents of amine end-groups per $10^6$ grams of polymer, but are not acid-dyeable.

As a result of the unique combination of composition and configuration provided in the filaments of this invention, the core is dyed by leveling acid dyes (monosulfonate dyes) but is not dyed by reserving acid dyes (polysulfonate dyes) in the normal dyeing pH range of 4 to 7. On the other hand, the sheath will not accept the acid dyes but will accept both level and nonleveling basic (cationic) dyes.

The amount of sheath and the concentration of sulfonate groups in the sheath polyamide are preferably selected so that the sheath dyes to about the same depth (degree of saturation) with the basic dyes as does the core dye with the leveling acid dyes to be used. Such a balance provides a separate and distinct color for the composite filament which is the "color-wheel" sum of the separate dyestuff colors of about equal saturation intensity with the filaments dyes with individual colors.

The sheath polymer normally should constitute at least about 40 percent by volume of the filament. A preferred range being 40/60 to 60/40 and most preferably both being present in substantially equivalent amounts. Preferably the filament cross-section is uniform along the filament.

Polyamides useful in this invention are the synthetic linear fiber-forming polycarbonamides such as those disclosed in U.S. Pat. No. 2,130,948 and U.S. Pat. No. 2,130,523 and more commonly referred to as nylon polymers. Such polymers are prepared from diamines and dicarboxylic acids and from amino carboxylic acids or their amide-forming derivatives. Particular examples include poly(hexamethylene adipamide), poly(epsilon-caproamide), poly(hexamethylene sebacamide), and polyamides of bis(4-aminocyclohexyl)methane with linear dicarboxylic acids containing from 9 to 16 carbon atoms and copolyamides of the aforementioned polyamides.

The basic-dyeable sheath polyamides contain an aromatic sulfonate group having an affinity to basic dyes and which is chemically attached to the polymer molecule. Preferably such polyamides are prepared by copolymerization of the polyamide-forming compounds with an aromatic compound containing a sulfonate salt group and one or two amide-forming functional groups preferably selected from carboxyl, carboxyester and aliphatic amine groups. Suitable aromatic groups include benzene, naphthalene and substituted derivatives thereof. Particularly suitable copolymerizable compounds include sodium or potassium salts of 3,5-dicarboxybenzenesulfonate; sodium or potassium salts of 2,5-dicarboxybenzenesulfonate; dicarbomethoxyesters of said sulfonates; ammonium-2,5- or 3,5-diaminodimethylbenzene sulfonate; and disodium-2,6-dicarboxynaphthalene disulfonate. The preparation of suitable polyamides is described in U.S. Pat. No. 3,184,436 to Magat.

Suitable acid-dyeable polyamides for the core include polyamides containing an excess amount of amine end-groups as a result of a slight excess of the diamine component during polymerization as described for example in U.S. Pat. No. 2,989,798 to Bannerman. Other deep acid-dyeable polyamides are described in U.S. Pat. No. 3,511,815 to Sayin.

The polyamides preferably have a relative viscosity of greater than about 30. Relative viscosity is the solution/solvent ratio of absolute viscosities at 25° C. when the solution is 8.4 percent by weight polymer and the solvent is aqueous 90 percent by weight formic acid.

Spinneret pack assemblies suitable for spinning the filaments of this invention are known, for example as disclosed in U.S. Pat. No. 2,936,482 to Kilian. Common melt-spinning and drawing procedures are employed.

The filaments may be of round or nonround cross-section including trilobal filaments as described for example in U.S. Pat. No. 2,939,201 and U.S. Pat. No. 2,939,202 to Holland. Such filaments may be crimped to produce bulked yarns by known suitable methods including stuffer-box crimping, gear-crimping, edge-crimping, false-twist texturing and hot-fluid jet bulking. The last is described in U.S. Pat. No. 3,186,155 to Breen and Lauterbach.

Yarns containing filaments of the invention are particularly useful as bulked, continuous filament styling yarns in carpets as well as other textile end-uses.

Filaments of the invention are useful in heather yarns mixed with other polyamide filaments in a single yarn, as well as in styling yarns where each yarn has filaments of only one species and the yarns are made into fabric in a predetermined geometry to obtain patterned color effects. For the core to be acid dyed in the pH range of 4 to 7, a leveling acid dye must be used. Reserving acid dyes do not penetrate the basic dyeable sheath at this pH. Surprisingly, if a filament is prepared having the acid-dyeable polyamide in the sheath and the basic-dyeable polyamide in the core, basic dyes will not penetrate the acid-dyeable sheath, and the basic-dyeable core remains substantially undyed.

The selective dyeability of the core which differentiates between leveling acid and reserving acid dyes is a key factor in providing new and additional styling versatility by this invention. For example, when the filaments are mixed with other acid-dyeable filaments and other basic-dyeable filaments and dyed in a bath containing a yellow leveling acid dye and a blue basic dye, whereupon the monocomponent filaments take on their respective yellow or blue color, in the composite filaments the sheath is dyed blue and the core is dyed yellow giving a green color. Further color effects can be achieved by also incorporating a reserving acid dye in the bath whereupon the single component acid-dyeable filaments are dyed simultaneously by both acid dyes but the acid-dyeable core is dyes only by the leveling acid dye.

As a further example, textile articles comprising the subject sheath/core filaments along with light acid-, deep acid-, and basic-dyeable filaments can provide 4 different colors upon dyeing with only three properly selected dyes, or can provide 3 different colors with one color in 2 shades upon dyeing with only 2 properly selected dyes. The 4 different filament types may be mixed in each yarn or may each form separate yarns used individually or in plied constructions. Such an article competitively dyed with basic blue, reserving acid red, and leveling acid yellow dyes provides yellow light-acid-dyeable filaments, red deep-acid-dyeable filaments, blue basic-dyeable filaments, and green (blue plus yellow) sheath/core filaments of the invention. Use of a dispersed dye can broaden styling versatility even further.

Mixed filament yarns may be prepared readily by cospinning filaments of the invention with monocomponent filaments of the sheath or core polyamides.

EXAMPLE I

This example demonstrates the unusual dyeing behavior of the filaments of this invention and also the type of dye styling effects which can be obtained when the filaments are used with monocomponent filaments of the sheath polymer and of the core polymer.

Filaments are prepared by melt-spinning a deep acid-dyeable poly(hexamethylene adipamide) flake and a basic-dyeable poly(hexamethylene adipamide) flake using a 34-hole, concentric, sheath/core spinneret pack fed by twin screw-melters. The acid-dyeable flake (A) has a relative viscosity of 37 and contains 98 equivalents/$10^6$g. of amine end-groups and ca. 60 equivalents/$10^6$g. of carboxyl end-groups. The basic-dyeable flake (B) has a relative viscosity of 36 and contains 40 equivalents/$10^6$g. of amine end-groups, ca. 95 equivalents/$10^6$g. of carboxyl end-groups plus 78 equivalents/$10^6$g. of aromatic sulfonate groups for basic-dyeability as the result of copolymerization of the poly(hexamethylene adipamide) with sodium 3,5-dicarboxybenzene sulfonate.

The polymer supply is regulated to spin a 34-filament yarn having a drawn denier of about 600. The amount of each polymer in the filaments is regulated by adjusting the relative pump speed for each polymer being fed to the spinneret. For example, equal pump speeds are used to produce filaments having a 50/50 composition by volume. The filaments are drawn to produce molecular orientation using a draw ratio of about 4.1X in two stages using first a heated pin and then a heated pipe to assist the drawing.

For comparison, monocomponent filaments are prepared by feeding the same polymer to both screw melters. The composite filaments are spun by feeding the appropriate polymers to the sheath and core supply for the spinneret pack. The following items are prepared:

| FLAKE SUPPLY SHEATH/CORE | FLAKE RATIO (By volume) |
|---|---|
| A/A* | 50/50 |
| A/B* | 50/50 |
| B/B* | 50/50 |
| B/A | 50/50 |
| B/A | 40/60 |
| B/A | 60/40 |

*Control Items, not of the invention

Sample yarn skeins of the four 50/50 items are scoured and separately dyed under normal conditions at pH 6 with a basic blus dye (Sevron ® Blue 2G, Basic Blue 22), a reserving orange acid dye (Neutral Fast Orange G, Mordant Orange 6 C.I. 26520) and with both dyes together with the following results:

| DYE | ITEM | SKEIN COLOR |
|---|---|---|
| basic blue | A/A | light blue tint |
| basic blue | A/B | light blue tint |
| basic blue | B/B | blue |
| basic blue | B/A | blue |
| orange acid | A/A | orange |
| orange acid | A/B | orange |
| orange acid | B/B | pink tint |
| orange acid | B/A | pink tint |
| both dyes | A/A | orange |
| both dyes | A/B | orange(less) |
| both dyes | B/B | blue |
| both dyes | B/A | blue(less) |

The monocomponent control items are seen to dye with their respective acid or basic dye as expected. At the pH of 6 only the sheath of the sheath/core filaments is dyed with its respective dye and the core remains undyed by the reserving acid dye. However, the B/A item of the invention at a pH of 3 readily dyes with the orange acid dye, and the dye bath is exhausted. At this low pH, however, the sheath is not dyeable by the basic blue dye thus preventing useful cross-dyeing of both the sheath and the core with these two dyes.

Further possibilities for cross-dyeing styling effects are tested by dyeing three-gram sample skeins of yarn competitively with the monocomponent control yarns in selected dye baths. In addition to the dyes, the baths contain one percent Alkanol ® CNR (condensation product of tallowamine with 16 moles of ethylene oxide followed by reaction of the end groups with sulfamic acid used to assist dyeing), three precent monosodium phosphate, 0.5 percent trisodium phosphate and 0.5 percent acetic acid (all on weight of fiber) with the final pH adjusted to 5.5. Basic and disperse dyes are added to cold baths and mixed for ten minutes. Acid dyes are also added to a cold bath. The yarns are dyed in the bath while boiling for 60 to 90 minutes.

Dye bath combinations and resulting skein color combinations are shown in Table 1.

From Table 1, it can be seen that the filaments of this invention, having the basic-dyeable sheath and acid-dyeable core (i.e. with leveling acid and not reserving acid dyes), provide extra versatility in obtaining differential dye effects when dyed in combination with other acid-dyeable and basic-dyeable filaments.

TABLE 1

| Combination No. | Skein Dyeing Dyes* % | Type | Color | Filament Combination S/C Type | Skein Color |
|---|---|---|---|---|---|
| 2 | 0.5 | Basic | Blue[1] | A/A | Yellow |
| | 1.7 | L. Acid | Yellow[2] | B/B | Blue |
| | | | | B/A | Green |
| 3 | 1.5 | Basic | Blue[1] | A/A | Yellow |
| | 0.5 | L. Acid | Yellow[2] | B/B | Blue |
| | | | | A/B | Yellow |
| 4 | 0.5 | Basic | Blue[1] | A/A | Red |
| | 1.7 | L. Acid | Yellow[2] | B/B | Blue |
| | 0.5 | R. Acid | Red[3] | B/A** | Green |
| 5 | 0.8 | Basic | Blue[1] | A/A | Brown |
| | 0.3 | R. Acid | Red[3] | B/B | Blue |
| | 0.15 | R. Acid | Blue[4] | B/A | Green |
| | 0.45 | R. Acid | Yellow[5] | | |
| | — | L. Acid | Yellow[2] | | |
| 6 | 0.5 | Disperse | Yellow[6] | A/A | Red |
| | 0.5 | Basic | Blue[1] | B/B | Green |
| | 1.5 | L. Acid | Red[7] | B/A | Brown |
| 7*** | 0.5 | Basic | Blue[8] | A/A | Red |
| | 0.5 | R. Acid | Red[3] | B/B | Blue |
| | 1.7 | L. Acid | Yellow[2] | B/A | Green |
| | | | | T-845+ | Yellow |

*% is on weight of fiber; L. Acid is leveling acid and R. Acid is reserving acid dyes respectively.

**Approximately 40/60 sheath/core content by volume, others are about 50/50.

***Prior to dyeing, all the yarns were textured in a hot fluid jet to provide yarns containing filaments having random, three-dimensional, curvilinear crimp and reversing "S" and "Z" filament twist throughout their length as disclosed in U.S. Pat. No. 3,186,155 - Breen and Lauterbach.

+A commercial light acid-dyeable poly(hexamethylene adipamide) yarn dyeable with leveling acid dyes containing about 15 equivalents/$10^6$ g. of amine end-groups.

[1] Sevron ® Blue B, Basic Blue 21
[2] Merpacyl ® Yellow 9G (similar to Acid Yellow 49)
[3] Acid Red
[4] Acid Blue 298
[5] Acid Yellow 200
[6] Acetamine Yellow CG, C.I. 11855, Disperse Yellow 3
[7] Merpacyl ® Red B, Acid Red 266
[8] ® Blue GCN, Basic Blue 97

EXAMPLE II

Using the same sheath polymer (B) and core polymer (A) of Example I, yarns are prepared of filaments of round cross-section and also of trilobal cross-section having a modification ratio of 2.3 as described in U.S. Pat. No. 2,939,201 – Holland. The round filament yarn contains 68 filaments and has a denier of 1200. The trilobal filament yarn also contains 68 filaments and has a drawn denier of 1200.

The filaments in both yarns are of substantially 50/50 sheath/core composition. The acid dyeable core is readily detected in filament cross-sections under a microscope using an acid dye to stain the core. The sheath/core ratio can be analyzed by making a Xerox copy of a photomicrograph of the filament cross-section and comparing the weight of a cut-out of the entire filament cross-section with a cut-out of the core. In this manner, the content of a filament selected at random from the round-filament yarn is found to contain 54/46 sheath/core composition and a trilobal filament selected at random is found to have a 52/48 composition.

Each yarn is hot-fluid jet textured for use in preparing tufted carpet samples in combination with commercial textured, basic-dyeable 66-nylon yarns and deep acid-dyeable 66-nylon yarns (about 90 amine end-groups/$10^6$g.). Also bulked heather yarns are prepared by co-bulking the sheath/core filament yarns with the commercial acid-dyeable and basic-dyeable polyamide yarns. Carpet samples are prepared from the textured yarns tufted into a spun-bonded polypropylene backing in both heather and banded configurations - depending upon use of the cobulked or separately bulked yarns, respectively. The carpet samples are pot-dyed or back-dyed with various combinations of acid and basic dyes at a pH of 6.0 to give various three-color combinations and two-color, two-tones. Typical results are shown in Table 2.

TABLE 2

| Sample No. | Dyes | Carpet Dyeing Yarn Component Color S/C | T-854* | T-857** |
|---|---|---|---|---|
| 1 | 1.7% Merpacyl® Blue SW[1]<br>0.9% Acetamine® Yellow CG<br>0.02% Sevron® Yellow 8GMF[2] | Dk. Green | Yellow | Dk. Blue |
| 2 | 0.7% Sevron® Blue B<br>1.7% Merpacyl® Yellow 8G | Green | Lt. Blue | Yellow |
| 3 | 0.7% Sevron® Yellow 8GMF[3]<br>1.7% Merpacyl® Red G[4] | Orange | Yellow | Red |
| 4 | 1.5% Nylon Black NS[5] | Brown | Lt. Beige | Black |

[1]C.I. 62055, Acid Blue 25
[2]Basic Yellow 53
[3]Basic Yellow 53
[4]Acid Red 337
[5]Mixture of Acid Orange 116 and Acid Blue 113
*A commercial basic-dyeable, bulked continuous filament (BCF) 66-nylon yarn.
**A commercial deep acid-dyeable, BCF 66-nylon yarn.

The above commercial basic-dyeable and acid-dyeable monocomponent filaments have a substantially quadrilateral cross-section with four continuous voids for improved luster and soiling performance.

What is claimed is:

1. A synthetic polyamide filament composed of: an acid-dyeable fiber-forming polyamide core which constitutes at least about 40 volume percent of the filament and which contains from 40 to 100 equivalents of amine end-groups per $10^6$ grams of the core polyamide; and, a substantially concentric, basic-dyeable, fiber-forming polyamide sheath which contains at least 50 equivalents of chemically attached aromatic sulfonate groups per $10^6$ grams of the sheath polyamide.

2. A filament of claim 1 having a sheath/core ratio by volume of from 60/40 to 40/60.

3. A filament of claim 1 wherein the core polymer contains from 60 to 90 equivalents of amine end groups per $10^6$ grams of core polyamide.

4. A filament of claim 1 wherein the sheath comprises a copolyamide containing from 60 to 80 equivalents of copolymerized aromatic sulfonate groups per $10^6$ grams of the copolyamide.

5. A filament of claim 1 having substantially equal amounts by volume of the core and sheath polyamide.

6. A textile article comprised of the filaments of claim 1.

7. A textile article of claim 6 further containing monocomponent filaments of a basic-dyeable polyamide in combination with monocomponent filaments of an acid-dyeable polyamide.

8. A textile article of claim 7 wherein the textile article is a continuous, multifilament yarn.

9. A textile article of claim 6 wherein the textile article is a tufted carpet.

10. A dyeing process comprising cross-dyeing filaments of claim 1 in an aqueous dye bath containing a basic dye and a leveling acid dye at a pH of from 4 to 7.

* * * * *